US006287156B1

(12) United States Patent
Swan et al.

(10) Patent No.: US 6,287,156 B1
(45) Date of Patent: Sep. 11, 2001

(54) ELECTRICAL TERMINAL CONNECTOR

(75) Inventors: James L. Swan, Wixom; David J. Berels, Plymouth; Jerome Ng, Ann Arbor; Stephen J. Wisner, Harrison Township, all of MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 09/651,928

(22) Filed: Aug. 31, 2000

(51) Int. Cl.[7] ..... H01R 13/87; H01R 11/03
(52) U.S. Cl. ..... 439/845; 439/790
(58) Field of Search ..... 430/284, 285, 430/287, 290, 291, 740, 843, 844, 845, 846, 851, 856, 877, 878, 879, 790

(56) References Cited

U.S. PATENT DOCUMENTS

| | | | | |
|---|---|---|---|---|
| 2,523,465 | | 9/1950 | Graham . | |
| 2,615,736 | | 10/1952 | Bergan et al. . | |
| 2,636,071 | | 4/1953 | Matthysse . | |
| 2,744,244 | | 5/1956 | Schumacher et al. . | |
| 2,785,387 | | 3/1957 | Batcheller . | |
| 3,079,579 | | 2/1963 | Crimmins et al. . | |
| 3,169,814 | | 2/1965 | Collins . | |
| 3,471,823 | | 10/1969 | Renshaw, Jr. . | |
| 3,514,740 | | 5/1970 | Filson . | |
| 3,516,043 | | 6/1970 | Spofford . | |
| 3,838,387 | * | 9/1974 | Grillet | 339/244 |
| 4,199,208 | | 4/1980 | Hawkins . | |
| 4,291,934 | * | 9/1981 | Kund | 439/421 |
| 5,035,655 | * | 7/1991 | Hesse | 439/699 |
| 5,108,304 | | 4/1992 | Bogiel et al. . | |
| 5,911,605 | | 6/1999 | Wooldridge et al. . | |
| 5,980,321 | * | 11/1999 | Cohen et al. | 439/608 |
| 6,062,918 | * | 5/2000 | Myer et al. | 439/839 |

* cited by examiner

*Primary Examiner*—Paula Bradley
*Assistant Examiner*—Larisa Tsukerman
(74) *Attorney, Agent, or Firm*—Brooks & Kushman P.C.

(57) ABSTRACT

An electrical connector having a terminal blade that has two spaced legs between which a spring contact strip is received. An L-shaped tab extends from one leg to the other to lock the two legs together in a spaced relationship. The spring contact strip has locking tabs that are received in openings in the terminal blade to hold the contact strip in the blade. Lead in tabs and stops are provided on the contact strip to aid in assembly of the contact strip to the terminal blade.

3 Claims, 2 Drawing Sheets

ELECTRICAL TERMINAL CONNECTOR

TECHNICAL FIELD

The present invention relates to electrical terminal connectors.

BACKGROUND ART

Electrical terminal connectors generally include a male terminal and a female receptacle. A universal terminal connection was the subject of U.S. Pat. No. 5,911,605 to Wooldridge. This design offered many advantages flowing from the fact that two generally identical parts can be used as a terminal connection. This design also offers a large number of contact points and an extensive contact area.

The present invention focuses on improving the design of the prior art Wooldridge patent that improves the manufacturability and robustness of the terminal design. The prior design also did not facilitate automatic assembly.

One problem encountered by the prior terminal blade was that the terminal connectors were subject to thermal expansion that could cause expansion of the gap defined by the terminal blade. A gap or looseness in the fit of one terminal to another could result in a reduction of contact pressure. In addition, the terminal blade in the prior terminal blade required careful alignment so that the two squared off terminal blades could be assembled together. Furthermore, the wire crimp connector of the prior terminal blade included a wire crimp connector having a smooth surface that was not well adapted to clamping small gauge wires to a flexible cable.

The prior design included a spring contact strip that was not easily assembled by means of automated assembly tools. Difficulty in locating the spring contact strip within the terminal blades was caused by a lack of effective locating devices for holding the contact strip in place in the blade, a lack of insertion alignment guides and a lack of positive stops for preventing over-insertion of the spring contact strip in the terminal blade.

These and other disadvantages and problems related to the prior art are addressed by Applicant's invention as summarized below.

DISCLOSURE OF INVENTION

According to the present invention, an electrical terminal connector is provided that comprises a blade having two spaced legs connected on a first edge by a bight. The connector includes a wire crimp connector. The wire crimp connector has a knurled surface on one side thereof that contacts small gauge wires of a high-flex cable that are gripped by the knurled surface of the crimp connector. An L-shaped tab extends from one of the legs to the other leg to lock the two spaced legs together in a spaced relationship thereby preventing expansion of the space between the legs. A spring contact strip having two spaced flanges connected by a reversely turned bend is received by the blade between the two spaced legs adjacent the bight with the reversely turned bend adjacent the bight.

According to another aspect of the present invention, an electrical terminal connector is provided that comprises a blade having two spaced legs connected on a first edge by a bight. The blade also has a wire crimp connector and at least one opening formed in each of the legs. A spring contact strip having two spaced flanges connected by a reversely turned bend is received by the blade between the two spaced legs adjacent the bight with the reversely turned bend adjacent the bight. The spring contact strip has locking tabs corresponding in number and location to openings formed in the legs. When the spring contact strip is assembled to the blade, the locking tabs of the spring contact strip are received in the openings in the blade. While any number of openings may be provided, two openings are preferably provided on each of the legs that receive two locking tabs of the spring contact strip. Openings in the legs are provided between the bight and the distal end of the legs. Locking tabs are provided on the distal end of the spaced flanges of the spring contact strip.

The present invention also relates to providing an electrical terminal connector comprising a blade having two spaced legs connected on a first edge by a bight and also including a wire crimp connector. A spring contact strip having two spaced flanges is connected by a reversely turned bend. The spring contact strip is received by the blade between the two spaced legs adjacent the bight with a reversely turned bend adjacent the bight. The spring contact strip includes stops on an exterior edge of the two spaced flanges that extend substantially perpendicular from the reversely turned edge. Upon assembly of the spring contact strip to the blade, the stops engage an edge of the spaced legs that extends substantially perpendicularly from the bight to prevent the contact strip from being inserted too deeply into the blade. The leading edges of the blade extend substantially perpendicularly from the bight and each preferably includes a notch for receiving one of the stops.

In accordance with another aspect of the present invention, a blade having two spaced legs connected on a first edge by a bight and having a wire crimp connector is provided. A spring contact strip having two spaced flanges connected by a reversely turned bend is received by the blade between the two spaced legs adjacent the bight with the reversely turned bend adjacent the bight. The spring contact strip includes lead in flanges on an interior edge of the two spaced flanges thereof that extend substantially perpendicular from the reversely turned edge. During assembly of the spring contact strip to the blade, each of the lead in flanges contact an edge of the spaced legs that extend substantially perpendicularly from the bight to facilitate assembly of the spring contact strip to the blade.

According to the invention, an electrical terminal connector is provided that includes a blade as previously described and a spring contact strip having two spaced flanges connected by a reversely turned bend. The spring contact strip is received as described above between the two spaced legs of the blade. The spring contact strip preferably includes louvers formed in each of the two spaced flanges and dimples formed on the two spaced flanges adjacent the louvers to resist over-compression of the louvers. A dimple is preferably provided adjacent both ends of each elongated louver.

The present invention also comprehends an electrical connection comprising first and second electrical terminal connectors of substantially identical configuration. The first and second electrical terminal connectors each have a blade formed to have two spaced legs connected on a first edge by a bight and a crimp connector. An L-shaped tab is provided that has a first segment extending from one of the legs to the other leg and a second segment extending from the outside of the other leg to lock the two spaced legs together in a spaced relationship thereby preventing expansion of the space between the legs. A spring contact strip having two spaced flanges connected by a reversely turned bend is received by the blade between the two spaced legs adjacent the bight. The first and second terminal connectors are assembled to each other and inverted relative to each other.

The spaced legs of the first and second electrical terminal connectors preferably each include a distal edge opposite their respective bights. The distal edges are tapered on a corner opposite the wire crimp connector to facilitate connecting first and second electrical terminal connectors together.

These and other objects and advantages of the present invention will be better understood in view of the attached drawings and detailed description of the invention.

BEST MODE FOR CARRYING OUT THE INVENTION

Figure 1:
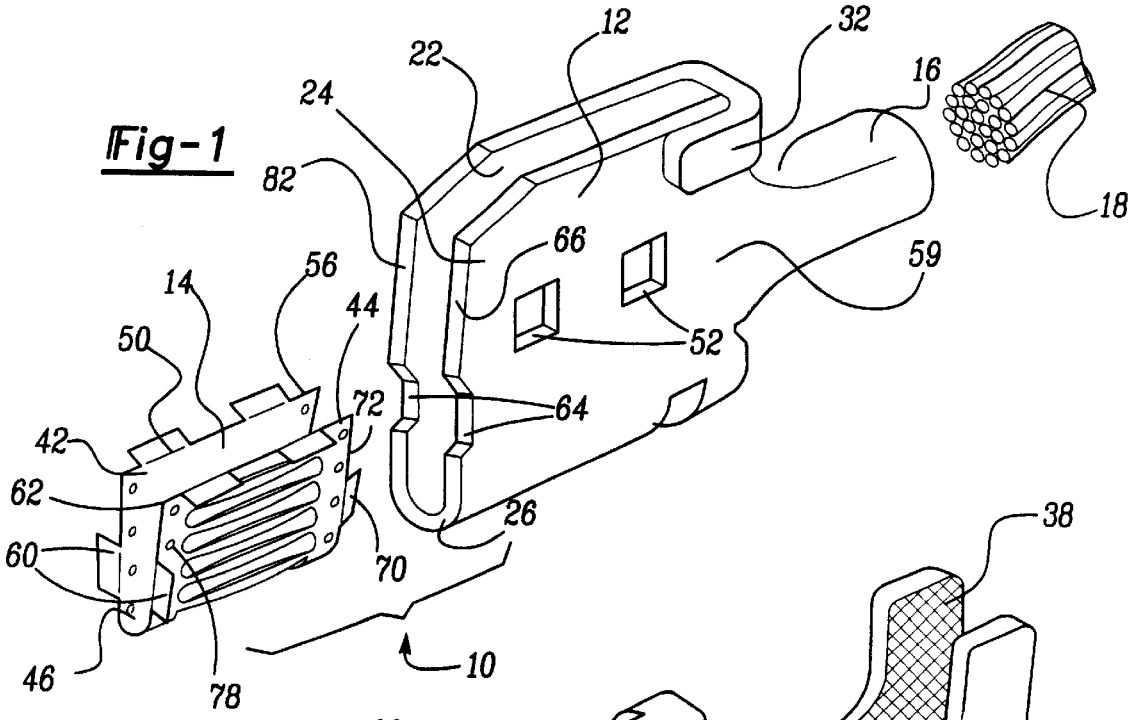
FIG. 1 is an exploded perspective view of a terminal connector partially assembled.

Referring now to FIG. 1, an electrical terminal connector 10 is shown in an exploded perspective view. Electrical terminal connector 10 includes a blade 12 within which is received a spring contact strip 14. The blade 12 includes a wire crimp connector 16 to which a flex cable 18 is secured as is well known in the art.

The blade 12 includes first and second legs 22 and 24 that are connected on one edge by a bight 26. The blade 12 is generally U-shaped with the first and second legs combining with bight 26 to form the U-shaped cross-section.

Figure 2:
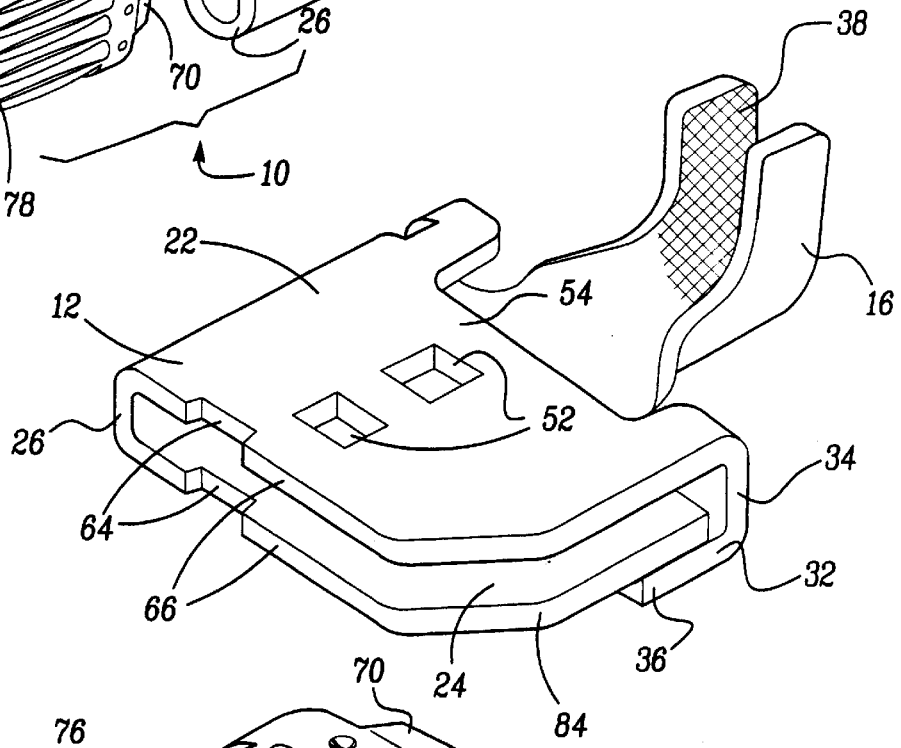
FIG. 2 is a perspective view of a terminal connector blade made in accordance with the present invention.
Figure 4:
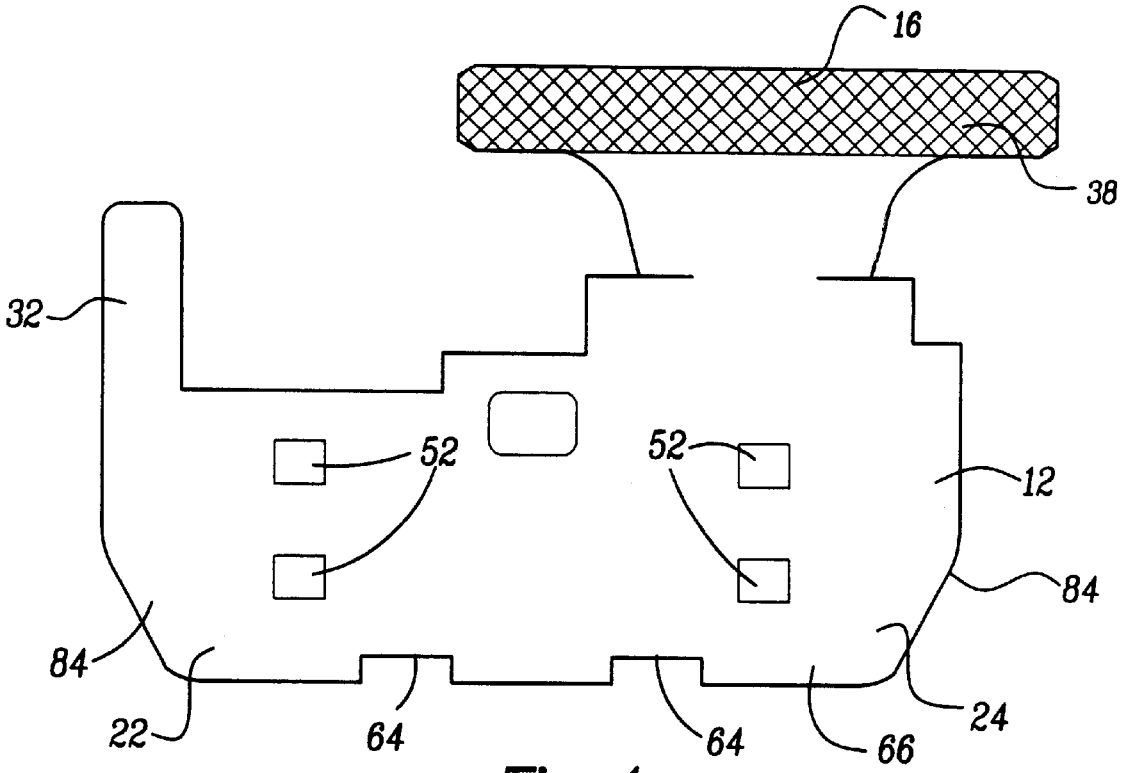
FIG. 4 is a blank used in forming a blade for an electrical terminal connector made in accordance with the present invention.

Referring now to FIGS. 1, 2, and 4, an L-shaped tab 32 is provided on the first leg 22. The L-shaped tab includes a bridging portion 34 and a retaining portion 36. Bridging portion 34 is a portion of the L-shaped tab 32 that extends from the first leg 22 to the second leg 24. Retaining portion 36 extends a short distance on the obverse side of the second leg 24 from the first leg 22. The inner surface of the wire crimp connector 16 is provided with a knurled surface 38 that improves the grip of the wire crimp connector 16 on the flex cable 18. Flex cable 18 is made up of a plurality of small gauge wires.

Figure 3:
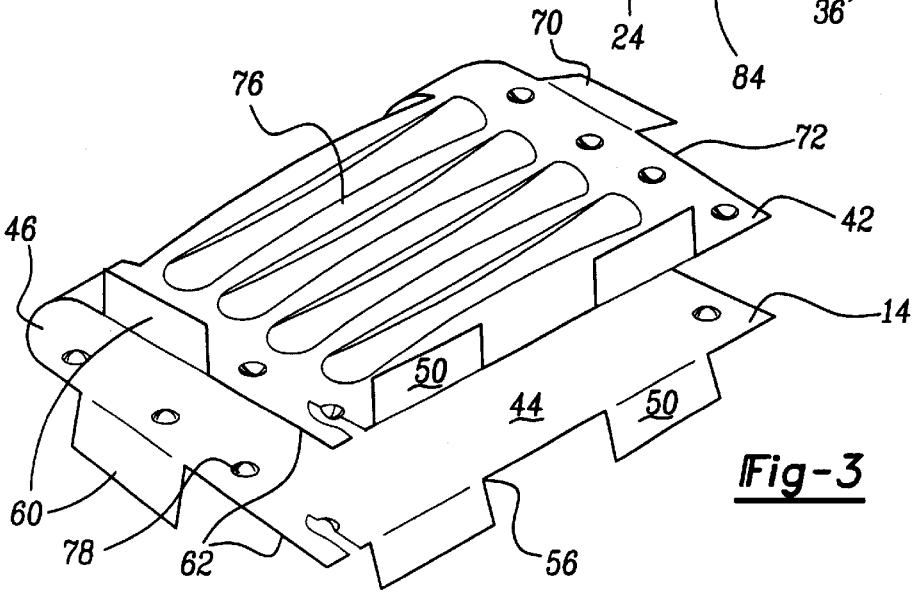
FIG. 3 is a perspective view of a spring contact strip made in accordance with the present invention.
Figure 5:
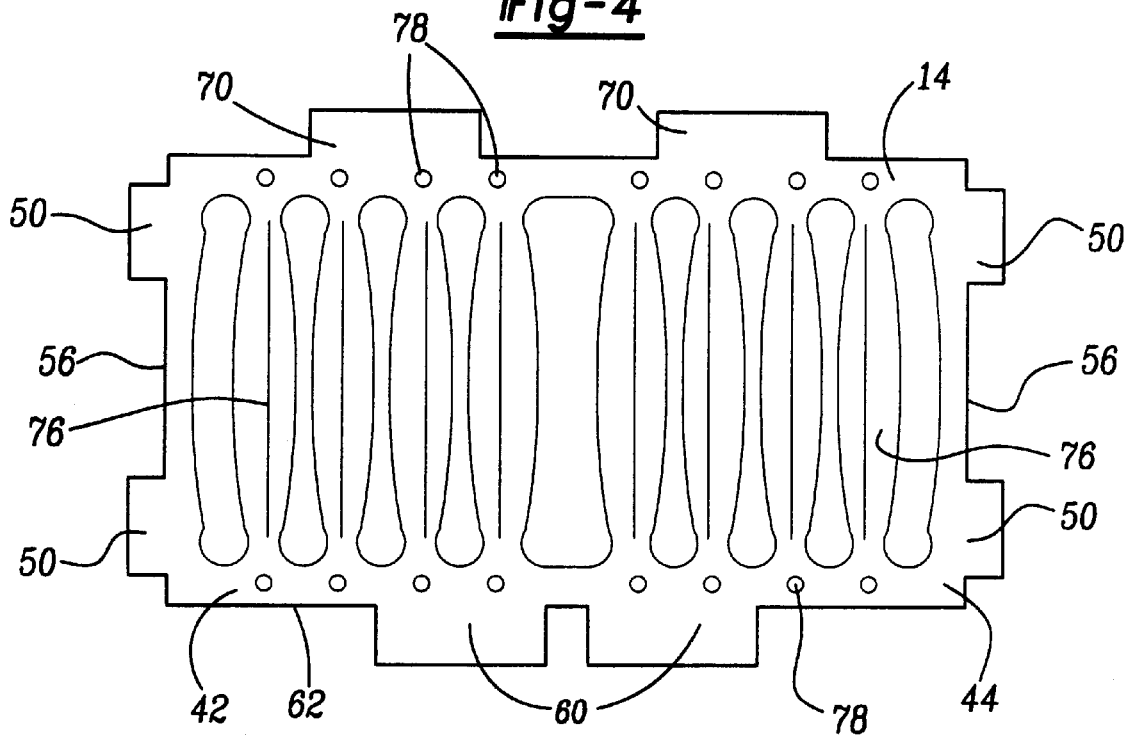
FIG. 5 is a blank used in forming a spring contact strip of an electrical connector made in accordance with the present invention.

Referring now to FIGS. 1, 3 and 5, spring contact strip 14 includes first and second flanges 42 and 44 that are interconnected by a reversely turned bend 46. Locking tabs 50 on the spring contact strip 14 are received in openings 52 formed in intermediate portions 54 of the blade 12. Locking tabs 50 are preferably formed on the ends 56 of the spring contact strip 14 on the end opposite the reversely-turned bend 46. Openings 52 are square openings or windows that are sized to receive the locking tabs 50.

Stops 60 are provided on an exterior edge 62 of the spring contact strip 14. Stops 60 are received in notches 64 formed in a leading edge 66 of the blade 12. Spring contact strip 14 is inserted between first and second legs 22 and 24 of the blade 12, preferably by an automated assembly machine. Stops 60 engage the notches 64 and thereby prevent over-insertion or mis-location of the spring contact strip 14 in the blade 12.

Lead-in flanges 70 are provided on an interior edge 72 of the spring contact strip 14. Lead in flanges 70 extend generally toward each other to facilitate insertion of the spring contact strip 14 between the first and second legs 22 and 24 of the blade 12.

Spring contact strip 14 includes louvers 76 that are provided to improve contact between electrical terminal connectors 10. Louvers 76 are elongated members extending generally parallel to the reversely turned bend 46. Dimples 78 are preferably provided on opposite ends of the louvers 76 to prevent overcompression of the louvers 76.

The leading edges 66 of the blade 12 are preferably provided with a tapered corner 84. Tapered corner 84 provides a lead in surface when the connector 10 is mated with another connector 10 that has been rotated 180°.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An electrical terminal connector comprising:

a blade formed to have two spaced legs connected on a first edge by a bight, the blade also having a wire crimp connector;

a spring contact strip having two spaced flanges connected by a reversely turned bend, said spring contact strip being received by the blade between the two spaced legs adjacent the bight with the reversely turned bend adjacent the bight, the spring contact strip having lead in flanges on an interior edge of the two spaced flanges thereof that extend substantially perpendicularly from the reversely turned edge, and toward each other wherein during assembly of the spring contact strip to the blade each of the lead in flanges contact an edge of the spaced legs that extend substantially perpendicularly from the bight to facilitate assembly of the spring contact strip to the blade.

2. An electrical terminal connector comprising:

a blade formed to have two spaced legs connected on a first edge by a bight, the blade also having a wire crimp connector;

a spring contact strip having two spaced flanges connected by a reversely turned bend, said spring contact strip being received by the blade between the two spaced legs adjacent the bight with the reversely turned bend adjacent the bight, the spring contact strip having louvers formed in each of the two spaced flanges and dimples formed on at least one of the two spaced flanges adjacent the louvers.

3. The electrical terminal connector of claim 2 wherein the louvers are elongated and extend parallel to the reversely turned bend and wherein a dimple is provided adjacent both ends of each louver.

* * * * *